US008433227B2

(12) United States Patent
Blair et al.

(10) Patent No.: US 8,433,227 B2
(45) Date of Patent: Apr. 30, 2013

(54) BACKUP ROLL WITH CAPACITIVE COATING AND AN IMAGING DEVICE TRANSFER STATION EMPLOYING THE BACKUP ROLL

(75) Inventors: Bryan Michael Blair, Lexington, KY (US); Bartley Charles Gould, II, Lexington, KY (US); Peter Brown Pickett, Lexington, KY (US); Julie Ann Gordon Whitney, Georgetown, KY (US)

(73) Assignee: Lexmark International, Inc., Lexington, KY (US)

( * ) Notice: Subject to any disclaimer, the term of this patent is extended or adjusted under 35 U.S.C. 154(b) by 250 days.

(21) Appl. No.: 12/544,650

(22) Filed: Aug. 20, 2009

(65) Prior Publication Data

US 2011/0044733 A1 Feb. 24, 2011

(51) Int. Cl.
*G03G 15/01* (2006.01)
*G03G 15/20* (2006.01)

(52) U.S. Cl.
USPC ..... 399/313; 399/302; 399/308

(58) Field of Classification Search ..... 399/302, 399/308, 313
See application file for complete search history.

(56) References Cited

U.S. PATENT DOCUMENTS

| | | | | |
|---|---|---|---|---|
| 5,732,311 | A * | 3/1998 | May et al. | 399/159 |
| 7,347,808 | B2 * | 3/2008 | Beach et al. | 492/56 |
| 2007/0075296 | A1 * | 4/2007 | DeJesus et al. | 252/500 |
| 2007/0280748 | A1 * | 12/2007 | Yoshida | 399/302 |

* cited by examiner

*Primary Examiner* — Joseph S Wong

(57) ABSTRACT

A toner transfer station of an electrophotographic imaging device employs a backup roll having an inner electrically grounded cylindrical metal base core and an outer surface layer disposed about the inner base core. The outer surface layer may be formed of a polyurethane elastomer material to provide a capacitive coating with a thickness greater than 15 microns, a dielectric constant less than 12 and a resistivity of less than 3.00E+13 Ohm-cm.

23 Claims, 2 Drawing Sheets

| INPUTS | CASE 1 | CASE 2 | CASE 3 | CASE 4 | CASE 5 | CASE 6 |
|---|---|---|---|---|---|---|
| TONER CHARGE, uC/g | -50 | -50 | -50 | -50 | -50 | -50 |
| MEDIA RESISTIVITY, OHM-cm | 5.67E+09 | 5.67E+09 | 5.67E+09 | 5.67E+09 | 5.67E+09 | 5.67E+09 |
| BELT RESISTIVITY, OHM-cm | 5.48E+10 | 5.48E+10 | 5.48E+10 | 5.48E+10 | 5.48E+10 | 5.48E+10 |
| STR RESISTIVITY, OHM-cm | 9.06E+07 | 9.06E+07 | 9.06E+07 | 9.06E+07 | 9.06E+07 | 9.06E+07 |
| BUR COATING THICKNESS, um | 0.0 | 20.0 | 80.0 | 20.0 | 20.0 | 20.0 |
| BUR COATING RESISTIVITY, OHM-cm | N/A | 3.00E+13 | 3.00E+13 | 3.00E+13 | 3.00E+13 | 3.00E+11 |
| BUR COATING DIELECTRIC CONSTANT | N/A | 3.5 | 3.5 | 2.0 | 5.0 | 3.5 |

| OUTPUTS | | | | | | |
|---|---|---|---|---|---|---|
| VOLTAGE LIMIT AT PASCHEN BREAKDOWN, VOLTS | 1000 | 1100 | 1200 | 1200 | 1100 | 1100 |
| MAXIMUM FIELD AT PASCHEN BREAKDOWN, V/m | -4.05E+05 | -4.10E+05 | -6.26E+06 | -5.79E+05 | -6.26E+05 | -5.86E+05 |

*Fig. 3*

BACKUP ROLL WITH CAPACITIVE COATING AND AN IMAGING DEVICE TRANSFER STATION EMPLOYING THE BACKUP ROLL

CROSS REFERENCES TO RELATED APPLICATIONS

None.

BACKGROUND

1. Field of the Invention

The present invention relates generally to electrophotographic (EP) imaging devices and, more particularly, to a backup roll with a capacitive coating and an imaging device transfer station employing the backup roll to improve transfer efficiency and print quality in the imaging device.

2. Description of the Related Art

An electrophotographic (EP) imaging device uses electrostatic voltage differentials to promote the transfer of toner from component to component. During the transfer process, the toner is moved from a donating medium like a photoconductor or a transfer belt to an accepting medium, for example a belt or final media such as paper. Transfer is a core process in the entire EP printing process. The process starts when a photosensitive roll, a photoconductor, is charged and then selectively discharged to create a charge image. The charge image is developed by a developer roll covered with charged toner of uniform thickness. This developed image then travels to the first transfer process or the only transfer process in the case of direct-to-paper systems.

At first transfer the toner enters a nip area formed by a photoconductor roll and a transfer roll. The media to be transferred to either a transfer belt or a transport belt supporting paper which is in between these two rolls. Time, pressure and electric fields are all critical components of the quality of the transfer process. A voltage is applied to the transfer roll to pull charged toner off the photoconductor onto the desired medium. In a two transfer system the transfer belt, now carrying the charged toner travels to a second transfer nip, similar in many ways to the first transfer nip. Again the toner is brought into contact with the medium, which it must transfer to in a nip formed by several rolls. Typically a conductive backup roll and a resistive transfer roll make up the two primary sides of the nip. As with first transfer; time, pressure and applied fields are important for high efficiency transfer.

Transfer robustness is frequently measured as the amount of voltage between the lowest voltage where acceptable transfer occurs because sufficient electric field has been built to move toner, and the highest voltage at which acceptable printing still occurs before Paschen breakdown causes undesirable print artifacts. This difference, called a transfer window, varies across environments as the receiving media varies in its properties over those same environments. The larger the difference between these two voltages, the more latitude the imaging device design has for part to part variation and still yield good quality prints.

The low end of the transfer window is determined by how well the electric field (measured in Volts/meter) can be established, and how much field is then required to overcome the forces of adhesion between the toner and the donating media. The high end of the window is the point at which the field built to move the toner exceeds the Paschen limit, the limit at which the dielectric properties of the materials in the transfer nip will begin to conduct current, and a discharge event happens.

Depending on the location of the breakdown, various print defects will be present in the page, which would make the print unacceptable.

Many modifications have been made to transfer systems to increase the field strength during transfer to improve transfer efficiency and print quality. These modifications include larger nip widths, increased force (pressure) in the nip and pre-wrap to bring transferring members together prior to field increase. All of these improvements have made print quality significantly better in current color (multi-toner-layer) EP imaging devices; however, some issues remain. These imaging devices also tend to get too much non-uniform electric field in the transfer nip which causes the system to go into overtransfer pre-maturely. This means that print quality degrades significantly, and so operating windows are compressed or disappear.

Thus, there is still a need for an innovation that will address the specific problem of overtransfer in non-uniform electric field or high conductivity conditions.

SUMMARY OF THE INVENTION

The present invention meets this need by providing an innovation in which a capacitive coating is applied as an outer surface layer to an inner base core of the conductive metal backup roll to create an additional capacitor without loading the nip between the transfer and backup rolls with excessive additional resistance thereby increasing the operating window.

Accordingly, in an aspect of the present invention, a backup roll for an electrophotographic imaging device includes an inner base core substantially cylindrical in configuration and made of an electrically conductive metal material with the inner base core having an outer surface, and an outer surface layer disposed around the inner base core on the outer surface thereof. The outer surface layer is formed of capacitive coating material having a thickness greater than 15 microns, a dielectric constant less than 12 and a resistivity of less than 3.00E+13 Ohm-cm.

In an exemplary embodiment of the present invention, the capacitive coating of the outer surface core of the backup roll has a thickness from about 20 to about 80 microns, a dielectric constant from about 3.5 to about 5, and a resistivity from about 3.00E+11 to about 3.00E+13 Ohm-cm.

In another aspect of the present invention, a transfer station for toner transfer in an electrophotographic imaging device includes a transfer roll, and a backup roll forming a nip with the transfer roll for effecting toner transfer in the nip. The backup roll has the inner base core and outer surface layer of capacitive coating material as set forth above.

BRIEF DESCRIPTION OF THE DRAWINGS

Figure 1:
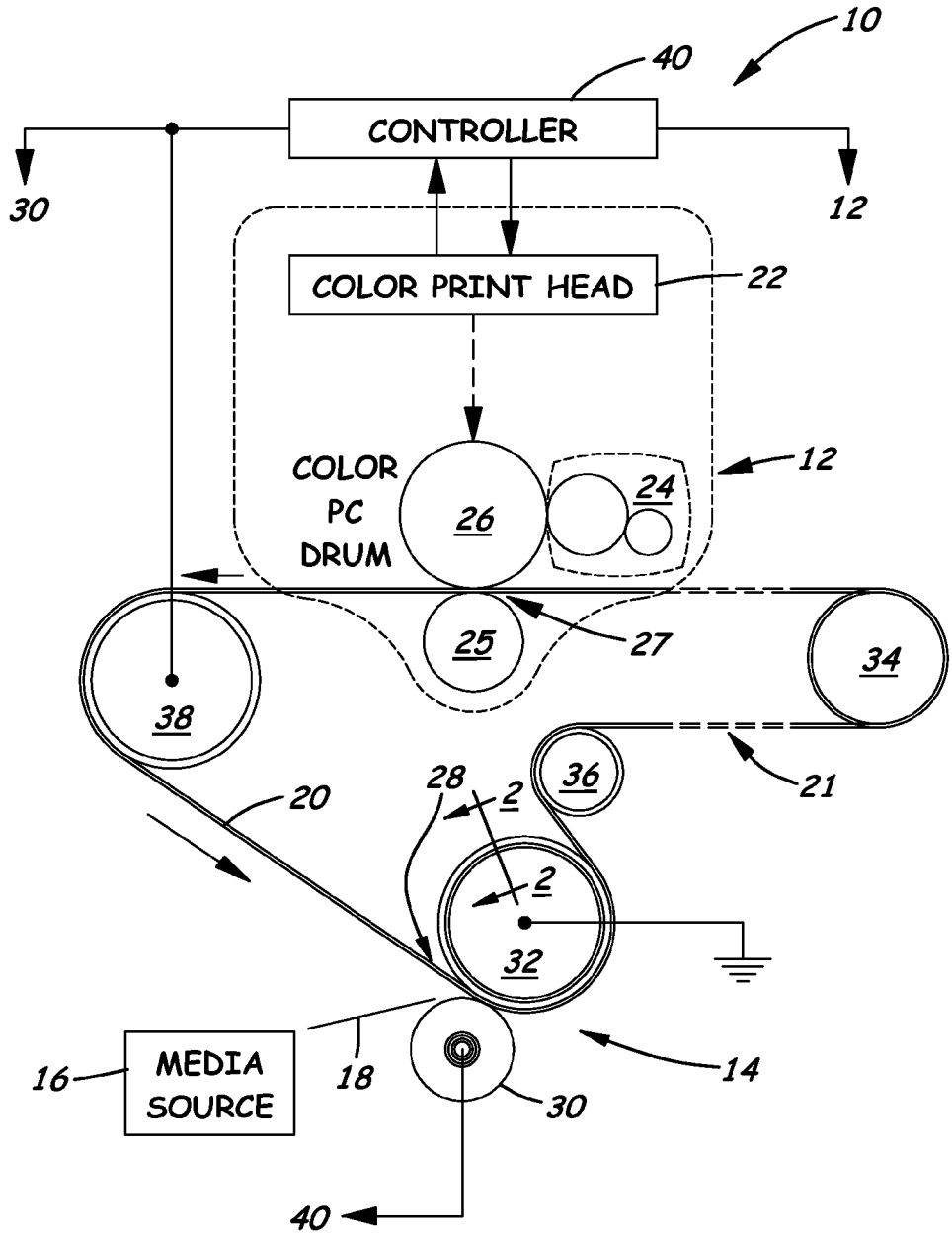

Having thus described the invention in general terms, reference will now be made to the accompanying drawings, which are not necessarily drawn to scale, and wherein:

FIG. 1 is a simplified partial schematic representation of an exemplary color EP imaging device having a backup roll to which a capacitive coating or layer is applied in accordance with the present invention.

Figure 2:
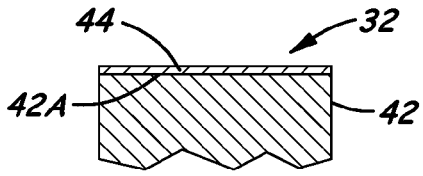

FIG. 2 is an enlarged fragmentary cross-section of the backup roll of the imaging device taken along line 2-2 in FIG. 1.

FIG. 3 is a table of exemplary values of coating thickness, resistivity, and dielectric constant to produce a maximum field at Paschen breakdown in volts per meter across a corresponding toner layer.

DETAILED DESCRIPTION

The present invention now will be described more fully hereinafter with reference to the accompanying drawings, in which some, but not all embodiments of the invention are shown. Indeed, the invention may be embodied in many different forms and should not be construed as limited to the embodiments set forth herein; rather, these embodiments are provided so that this disclosure will satisfy applicable legal requirements. Like numerals refer to like elements throughout the views.

Referring to FIG. 1, there is schematically illustrated in simplified form an exemplary embodiment of a color EP imaging device 10 to which the present invention may be applied. The imaging device 10 is a two transfer system which includes, in part, a plurality of first transfer, color image forming stations 12 (only one being shown), a second transfer station 14, a media source 16 for feeding one at a time a media sheet 18, of paper for instance, to the second transfer station 14, and an intermediate transfer member (ITM) belt 20 arranged to be moved along an endless path 21 that passes through the first and second stations 12, 14. By way of example, the color image forming stations 12 may provide respectively image layers having the colors, yellow (Y), cyan (C), magenta (M), and black (K). Each of the color image forming stations 12 includes a print head 22, a developer assembly 24, a first transfer roll 25, a photoconductive (PC) drum 26 and a first transfer nip 27 between the first transfer roll 25 and the PC drum 26. The print head 22 forms a latent image on the PC drum 26 in a manner known in the art. Toner (not shown) is supplied to the PC drum 26 by the developer assembly 24 to produce a toned partial image, known as a color separation or layer, from the latent image on the PC drum 26.

The color partial image layer produced at each of the first transfer stations 12 is transferred to the ITM belt 20 such that a composite color image accumulates thereon and then is transferred to the print medium, the media sheet 18, at the second transfer station 14 at a second transfer nip 28 defined between a second transfer roll 30 and a backup roll 32 positioned at the second transfer station 14. Both the media sheet 18 and ITM belt 20 pass through the second transfer nip 28 in contact with one another to enable the transfer of the composite color image to the media sheet 18 from the ITM belt 20. The ITM belt 20 wraps partially about each of the second transfer roll 30 and the backup roll 32 such that they are counter-rotated relative to one another by their respective contacts with the ITM belt 20. Also in FIG. 1, there is shown guide rollers 34, 36 located downstream of the second transfer station 14 and a drive roller 38 located upstream thereof. The imaging device 10 also includes a suitable controller 40 that controls all operations. The second transfer roll 32 is powered with, for example, a positive voltage from the controller 40. Further details of the conventional operations of the imaging device 10 as described above may be gained from U.S. Pat. No. 6,363,228, assigned to the assignee of the present invention, the disclosure of which is hereby incorporated herein by reference in its entirety.

In accordance with the present invention, referring now to FIGS. 1 and 2, the backup roll 32 at the second transfer station 14 has an electrically grounded inner base core 42, substantially cylindrical in configuration and made of a suitable electrically conductive metal, and an outer surface layer 44 in the form a coating of an insulative material, as compared to the metal base core 42, disposed on a substantially endless outer surface 42A of the inner base core 42. The coating material of the outer layer 44, which may be referred to as a "capacitive" coating in view of the electrical environment of the second transfer station 14, has a thickness greater than 15 microns, a dielectric constant less than 12 and a resistivity of less than 3.00E+13 Ohm-cm. In an exemplary embodiment of the present invention, the capacitive coating of the outer layer 44 has a thickness from about 20 to about 80 microns, a dielectric constant from about 3.5 to about 5, and a resistivity of from about 3.00E+11 to about 3.00E+13 Ohm-cm. The capacitive coating of the outer surface layer 44 may be a suitable polyurethane elastomer such as is commercially available from Lord Corporation of Akron, Ohio and identified by the trade names V021 and V022. Basically these are blends of two polydiisocyanate materials in aromatic solvents (mostly xylene). The metal of the electrically conductive base core 42 may be either of steel, copper or aluminum, and/or mixtures thereof.

Referring to the table of FIG. 3, there are shown backup rolls 32, including some with outer surface layers 44 of capacitive coatings of various thicknesses, resistivities and dielectric constants, which were tested at ambient conditions against an overtransfer print defect caused by worked toner. A control non-coated backup roll was used having a transfer voltage limited at 1000 volts as shown in Case 1. Above 1000 volts, pre-nip breakdown occurs and the maximum electric field at Paschen breakdown is −4.05E05 V/m across the toner layer. When the capacitive coating outer surface layer 44 of the present invention was modeled on the metal backup roll 32 wherein the capacitive coating of the outer surface layer 44 has a thickness of about 20 um, a dielectric constant of about 3.5 and a high resistivity (3E13 Ohm-cm) the transfer voltage limit was increased to 1100 volts and the electric field strength also increased slightly to −4.10E05 V/m across the toner layer as shown in Case 2. If the thickness of the capacitive coating of the outer surface layer 44, with the same other properties, is increased to 80 um as shown in Case 3, the transfer voltage before Paschen breakdown pre-nip increased to 1200 volts and the electric field at the same time increased to −6.26 E06 V/m across the toner layer. With the thickness of the capacitive coating of the outer surface layer 44 retained at a 20 um a decrease of its dielectric constant to 2.0 increased the transfer voltage at which the system went into over transfer to 1200 volts while increasing the electric field to −5.79E05 V/m across the toner layer as shown in Case 4; however, increasing the dielectric constant from 3.5 to 5 was not a significant change as shown in Case 5. Changing the resistivity of the capacitive coating by decreasing it increased the electric field. Decreasing the electric field to 3E11 ohm-cm improved the electric field from −4.1E05 to −5.86E05 for the same thickness and transfer limit as shown in Case 6.

According to the present invention, therefore, by applying to the conductive metal base core 42 of the backup roll 32, using known fabricating techniques, a capacitive coating on the outer surface layer 44 comprised of a polyurethane elastomer material, having the thickness, dielectric constant and resistivity within the ranges as given above with reference to FIG. 3, an additional capacitor is created without loading the nip with excessive additional resistance. The result is an inexpensive way to improve transfer quality in those situations where premature overtransfer can limit operating windows. Such conditions can exist in many normal printing scenarios such as a hot/wet environment, printing at slower printing speeds, using rougher media, a scenario with a mixture of multilayered solid toners and thin halftones in the same area of the page, or using worked CPT toner. In these situations the backup roll 32 with the outer surface layer 44 of the capacitive coating, can improve system performance at minimal additional cost or space.

The foregoing description of several embodiments of the invention has been presented for purposes of illustration. It is not intended to be exhaustive or to limit the invention to the precise forms disclosed, and obviously many modifications and variations are possible in light of the above teaching. It is intended that the scope of the invention be defined by the claims appended hereto.

What is claimed is:

1. A backup roll for an electrophotographic the backup roll forming a nip with a transfer roll, the backup roll comprising:
- an inner base metal core substantially cylindrical in configuration and having an outer surface; and
- an outer surface layer disposed around said inner base core on said outer surface thereof, said outer surface layer comprised of capacitive coating material having a thickness greater than 15 microns, a dielectric constant of about 3.5;
- wherein said outer surface layer is directly disposed on said outer surface of said inner base metal core, and wherein said outer surface layer of capacitive coating material has a resistivity from about 3.00E+10 to about 3.00E+11 Ohm-cm.

2. The backup roll of claim 1 wherein said outer surface layer of a capacitive coating is comprised of a polyurethane elastomer.

3. The backup roll of claim 1 wherein said capacitive coating material of said outer surface layer is an insulative material.

4. The backup roll of claim 1 wherein said inner base metal core is made of an electrically conductive metal material selected from the group consisting of steel, copper and aluminum, and/or mixtures thereof.

5. The backup roll of claim 1, wherein the outer surface layer resistivity is about 3.00E+11 Ohm-cm.

6. A transfer station for toner transfer in an electrophotographic imaging device, comprising:
- a transfer roll; and
- a backup roll forming a nip with said transfer roll for effecting toner transfer in said nip, the backup roll configured for receiving a transfer voltage during toner transfer without receiving a toner image thereon, said backup roll comprising:
  - an inner base core substantially cylindrical in configuration and made of an electrically conductive metal material, said inner base core having an outer surface; and
  - an outer surface layer disposed around said inner base core on said substantially outer surface thereof, said outer surface layer comprised of capacitive coating material having a thickness greater than 15 microns, a dielectric constant less than 12 and a resistivity of less than about 3.00E+13 Ohm-cm;
  - wherein said outer surface layer is directly disposed on said outer surface of said inner base core.

7. The transfer station of claim 6 wherein said outer surface layer of capacitive coating material of said backup roll has a thickness of about 80 microns.

8. The transfer station of claim 6 wherein said outer surface layer of capacitive coating material of said backup roll has a dielectric constant of about 2.

9. The transfer station of claim 6 wherein said outer surface layer of capacitive coating material of said backup roll has a resistivity from about 3.00E+10 to about 3.00E+11 Ohm-cm.

10. The transfer station of claim 6 wherein said outer surface layer of the capacitive coating material of said backup roll is comprised of a polyurethane elastomer.

11. The transfer station of claim 6 wherein said capacitive coating material of said outer surface layer of said backup roll is an insulative material.

12. The transfer station of claim 6 wherein said electrically conductive metal material of said inner base core of said backup roll is selected from the group consisting of steel, copper and aluminum, and mixtures thereof.

13. An electrophotographic imaging device, comprising:
- at least one image-forming first transfer station having a first transfer nip;
- a second transfer station having a second transfer nip; and
- an endless transfer belt transported in an endless path passing, first, through said first transfer nip at said at least one first transfer station where toner forming an image is deposited on said transfer belt and, second, into and through said second transfer nip of said second transfer station where the toner is transferred from said transfer belt onto a media sheet;
- said second transfer station including
  - a second transfer roll, and
  - a backup roll forming said second transfer nip with said second transfer roll for affecting the toner transfer in said second transfer nip from said transfer belt, said backup roll configured for receiving a transfer voltage during toner transfer without receiving a toner image thereon, said backup roll comprising:
    - an inner base core substantially cylindrical in configuration and made of an electrically conductive metal material, said inner base core having an outer surface; and
    - an outer surface layer disposed around said inner base core on said outer surface thereof, said outer surface layer comprised of capacitive coating material having a thickness greater than 15 microns, a dielectric constant less than 12 and a resistivity of less than about 3.00E+13 Ohm-cm;
  - wherein said outer surface layer is directly disposed on said outer surface of said inner base core.

14. The electrophotographic imaging device of claim 13 wherein said outer surface layer of capacitive coating material of said backup roll has a thickness from about 80 microns.

15. The electrophotographic imaging device of claim 13 wherein said outer surface layer of capacitive coating material of said backup roll has a dielectric constant of about 2.

16. The electrophotographic imaging device of claim 13 wherein said outer surface layer of capacitive coating material of said backup roll has a resistivity from about 3.00E+10 to about 3.00E+11 Ohm-cm.

17. The electrophotographic imaging device of claim 13 wherein said outer surface layer of the capacitive coating material of said backup roll is comprised of a polyurethane elastomer.

18. The electrophotographic imaging device of claim 13 wherein said capacitive coating material of said outer surface layer of said backup roll is an insulative material.

19. The electrophotographic imaging device of claim 13 wherein said electrically conductive metal material of said inner base core of said backup roll is selected from the group consisting of steel, copper and aluminum, and/or mixtures thereof.

20. The electrophotographic imaging device of claim 13, wherein said transfer belt has a resistivity of about 5.48E+10 Ohm-cm.

21. The electrophotographic imaging device of claim 13, wherein each at least one first transfer station has a photoconductive drum and a first transfer roll forming the first transfer nip.

22. The electrophotographic imaging device of claim 20, wherein said outer surface layer has a resistivity of about 3.0E+13 ohm-cm.

23. The electrophotographic imaging device of claim 20, wherein said outer surface layer has a resistivity of about 3.0+11 ohm-cm.

* * * * *